US009879631B2

(12) United States Patent
Kadobayashi

(10) Patent No.: US 9,879,631 B2
(45) Date of Patent: Jan. 30, 2018

(54) FUEL SUPPLY SYSTEM, MARINE PROPULSION DEVICE AND OUTBOARD MOTOR

(71) Applicant: YAMAHA HATSUDOKI KABUSHIKI KAISHA, Iwata-shi, Shizuoka (JP)

(72) Inventor: Yoshiyuki Kadobayashi, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 15/378,170

(22) Filed: Dec. 14, 2016

(65) Prior Publication Data

US 2017/0167427 A1 Jun. 15, 2017

(30) Foreign Application Priority Data

Dec. 15, 2015 (JP) ..... 2015-243945

(51) Int. Cl.

| | |
|---|---|
| ***F02M 37/00*** | (2006.01) |
| ***F02D 41/30*** | (2006.01) |
| ***B63H 20/00*** | (2006.01) |
| ***F02M 59/38*** | (2006.01) |
| *B63H 20/32* | (2006.01) |

(52) U.S. Cl.

CPC ..... *F02D 41/3082* (2013.01); *B63H 20/001* (2013.01); *F02M 37/0058* (2013.01); *F02M 37/0088* (2013.01); *F02M 59/38* (2013.01); *B63H 20/32* (2013.01); *F02D 2200/0602* (2013.01); *F02M 2200/247* (2013.01)

(58) Field of Classification Search

CPC ..... B63H 20/001; F02D 41/3082; F02M 37/058; F02M 37/088; F02M 59/38

See application file for complete search history.

(56) References Cited

U.S. PATENT DOCUMENTS 2,932,309 A * 4/1960 Godden ..... F16K 15/06 137/111
2,935,078 A * 5/1960 Greenland ..... B01J 4/008 137/202
3,592,213 A * 7/1971 Smith ..... B64D 37/14 137/809
6,357,423 B1 * 3/2002 Kanno ..... F02B 61/045 123/497

(Continued)

FOREIGN PATENT DOCUMENTS

JP 2000-220548 A 8/2000

*Primary Examiner* — Stephen P Avila

(74) *Attorney, Agent, or Firm* — Keating and Bennett, LLP

(57) ABSTRACT

A fuel supply system includes a sub fuel tank, a booster pump, a fuel pipe, a fuel pressure sensor and a controller. The sub fuel tank stores a fuel supplied thereto from a main fuel tank. The booster pump is disposed inside the sub fuel tank. The fuel pipe has a returnless structure and supplies the fuel with a pressure increased by the booster pump to a fuel injection device of an engine. The fuel pressure sensor detects the pressure of the fuel inside the fuel pipe. The controller is configured or programmed to perform a feedback control of the booster pump based on a value of the pressure of the fuel detected by the fuel pressure sensor such that the pressure of the fuel inside the fuel pipe becomes greater than or equal to a first threshold.

13 Claims, 5 Drawing Sheets

(56) References Cited

U.S. PATENT DOCUMENTS 6,910,464 B2 * 6/2005 Ishikawa ..... F02M 37/08
123/446
7,007,673 B2 * 3/2006 Treusch ..... F02M 69/465
123/456

* cited by examiner

FUEL SUPPLY SYSTEM, MARINE PROPULSION DEVICE AND OUTBOARD MOTOR

CROSS REFERENCE TO RELATED APPLICATIONS

This application claims the benefit of priority to Japanese Patent Application No. 2015-243945 filed on Dec. 15, 2015. The entire contents of this application are hereby incorporated herein by reference.

BACKGROUND OF THE INVENTION

1. Field of the Invention

The present invention relates to a fuel supply system, a marine propulsion device and an outboard motor.

2. Description of the Related Art

In general, a fuel supply system for an outboard motor includes a sub fuel tank that stores a fuel supplied from a main fuel tank, a booster pump disposed inside the sub fuel tank, a fuel pipe connected to both of the booster pump and a fuel injection device of an engine, and a pressure regulator that keeps constant the pressure of the fuel inside the fuel pipe. The pressure regulator returns an excess amount of the fuel inside the fuel pipe to the sub fuel tank through a return pipe in order to keep constant the pressure of the fuel inside the fuel pipe.

In this type of fuel supply system, the temperature of the fuel is increased due to radiation of heat from an electric motor that drives the booster pump, and bubbles are inevitably produced inside the fuel pipe. Especially when a small amount of the fuel is required to be injected in the engine, the excess amount of the fuel to be returned to the sub fuel tank increases. Hence, the temperature of the fuel is more likely to increase.

In light of this, for the purpose of reducing the excess amount of the fuel to be returned to the sub fuel tank, Japan Laid-open Patent Application Publication No. 2000-220548 discloses a method of reducing the discharge amount of the booster pump by controlling the duty cycle of the booster pump when a small amount of the fuel is required to be injected in the engine.

However, in the method described in Japan Laid-open Patent Application Publication No. 2000-220548, the excess amount of the fuel is similarly returned to the sub fuel tank through the return pipe. Hence, this method has a limitation in preventing an increase in the temperature of the fuel.

SUMMARY OF THE INVENTION

In view of the above, preferred embodiments of the present invention provide a fuel supply system, a marine propulsion device and an outboard motor that prevents an increase in a fuel temperature.

A fuel supply system according to a preferred embodiment of the present invention includes a sub fuel tank, a booster pump, a fuel pipe with a returnless structure, a fuel pressure sensor and a controller. The sub fuel tank stores a fuel supplied thereto from a main fuel tank. The booster pump is disposed inside the sub fuel tank. The fuel pipe with the returnless structure supplies the fuel with a pressure increased by the booster pump to a fuel injection device of an engine. The fuel pressure sensor detects the pressure of the fuel inside the fuel pipe. The controller is configured or programmed to perform a feedback control of the booster pump based on a value of the pressure of the fuel detected by the fuel pressure sensor such that the pressure of the fuel inside the fuel pipe becomes greater than or equal to a first threshold.

According to preferred embodiments of the present invention, it is possible to provide a fuel supply system, a marine propulsion device and an outboard motor that prevents an increase in the temperature of the fuel.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
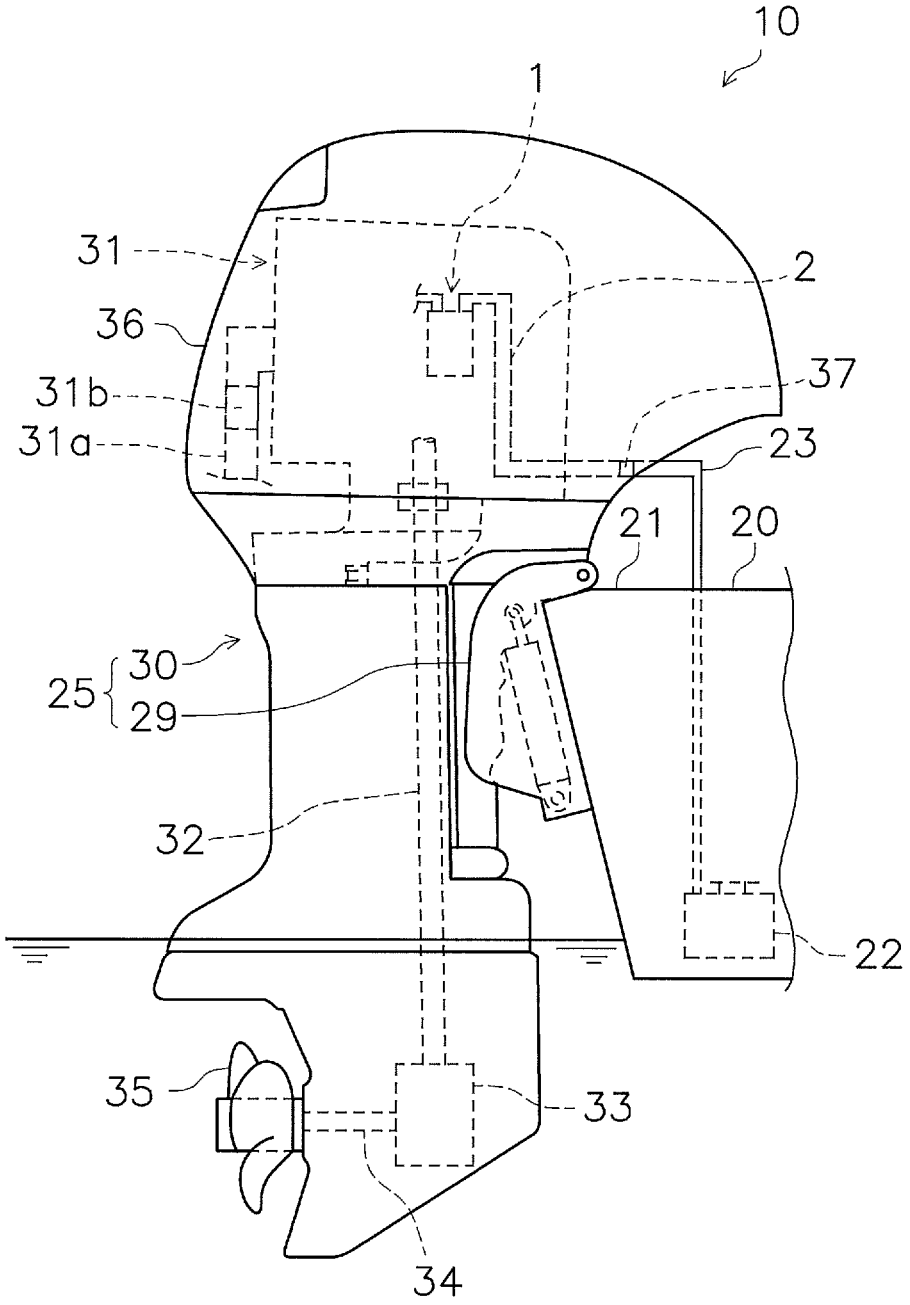
FIG. 1 is a side view of a construction of the rear end of a watercraft and its surroundings.

A watercraft 10 according to preferred embodiments of the present preferred embodiment will be explained below. FIG. 1 is a side view of a construction of the rear end of the watercraft 10 and its surroundings. The watercraft 10 includes a hull 20 and a marine propulsion device 25.

The hull 20 includes a transom 21, a main fuel tank 22 and an outside hose 23. The marine propulsion device 25 is fixed to the transom 21. The main fuel tank 22 stores a fuel to be supplied to the marine propulsion device 25. The outside hose 23 is connected to the main fuel tank 22 and the marine propulsion device 25. The fuel stored in the main fuel tank 22 is supplied to the marine propulsion device 25 through the outside hose 23.

The marine propulsion device 25 includes a bracket 29 and an outboard motor 30. The bracket 29 is attached to the transom 21 of the hull 20. The bracket 29 supports the outboard motor 30 such that the outboard motor 30 is pivotable in the right-and-left direction and the up-and-down direction.

The outboard motor 30 includes a fuel supply system 1, an engine 31, a drive shaft 32, a shift mechanism 33, a propeller shaft 34, a propeller 35, a cowling 36 and a hose connector 37.

The engine 31 is preferably an internal combustion engine, for example, that burns the fuel to generate a driving force. The engine 31 includes an exhaust pipe 31*a* and a catalyst 31*b*. The exhaust pipe 31*a* is connected to an exhaust channel (not shown in the drawings). The catalyst 31*b* is accommodated in the exhaust pipe 31*a*. The drive shaft 32 is coupled to the engine 31 and is rotated by the driving force of the engine 31.

The shift mechanism 33 is disposed between the drive shaft 32 and the propeller shaft 34. The shift mechanism 33 is movable to one of a forward thrust position, a neutral position and a backward thrust position, and switches the rotation of the propeller shaft 34 among a forward thrust state, a stopped state and a backward thrust state. The propeller 35 is attached to the rear end of the propeller shaft 34.

The cowling 36 accommodates the engine 31, the fuel supply system 1 and so forth. The hose connector 37 is attached to the cowling 36. The outside hose 23 and a fuel supply pipe 2 are connected to the hose connector 37. The fuel fed through the outside hose 23 is supplied to the engine 31 by the fuel supply system 1 including the fuel supply pipe 2.

Figure 2:
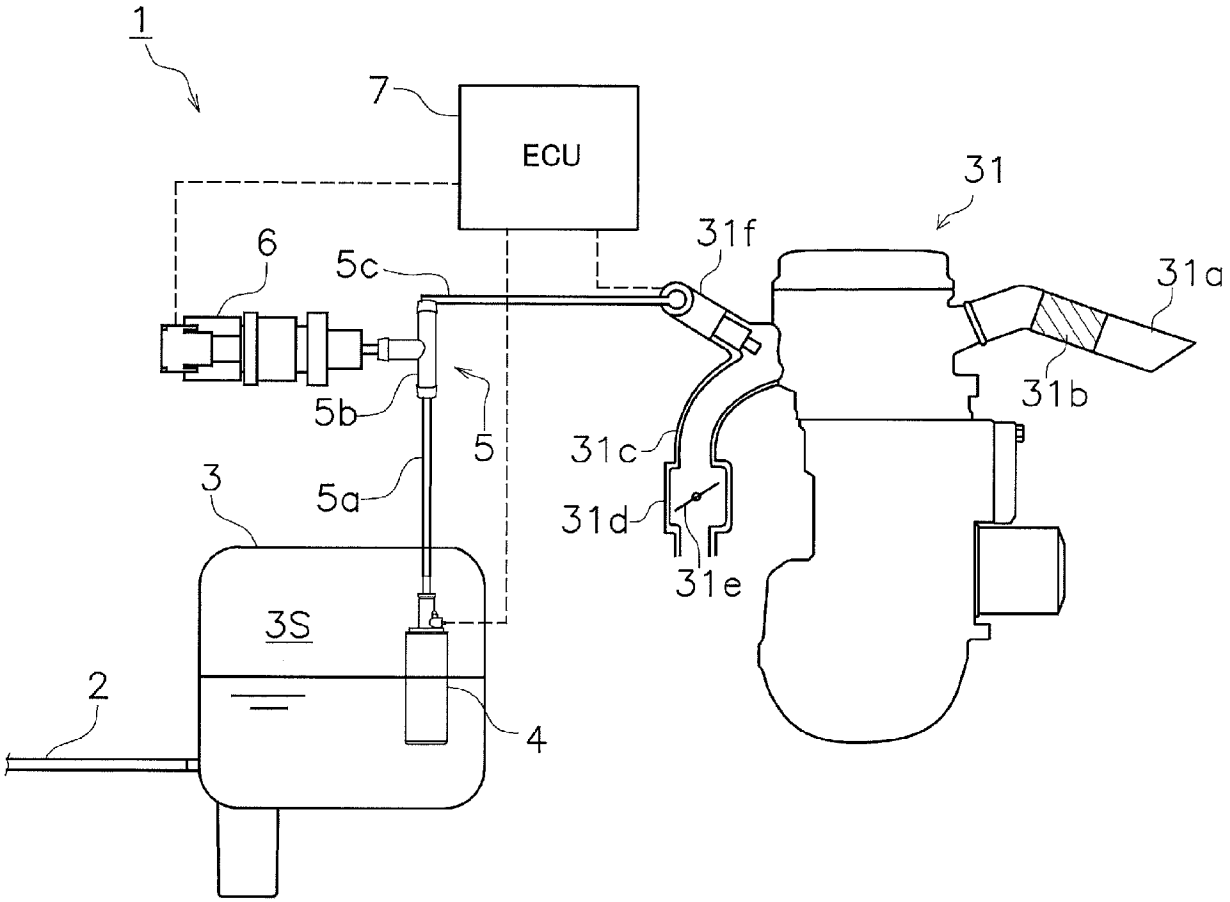
FIG. 2 is a schematic diagram of a configuration of a fuel supply system.

A configuration of the fuel supply system 1 that supplies the fuel to the engine 31 will be explained. FIG. 2 is a schematic diagram of the configuration of the fuel supply system 1.

The construction of the engine 31 will be explained. As shown in FIG. 2, the engine 31 includes an intake pipe 31*c*, a throttle body 31*d*, a throttle valve 31*e* and a fuel injection device 31*f* in addition to the exhaust pipe 31*a* and the catalyst 31*b*. The intake pipe 31*c* causes a mixed gas to flow therethrough in order to supply the mixed gas to a cylinder of the engine 31. The throttle body 31*d* is coupled to the intake pipe 31*c*. The throttle valve 31*e* is disposed inside the throttle body 31*d*. The throttle valve 31*e* regulates the flow rate of air to be supplied to the cylinder of the engine 31. During driving of the engine 31, the opening degree of the throttle valve 31*e* is controlled in response to a throttle operation by an operator.

The fuel injection device 31*f* injects the fuel supplied thereto from the fuel supply system 1 to the intake pipe 31*c* at a predetermined timing. The injection duration and the injection timing of the fuel by the fuel injection device 31*f* are controlled by a controller 7 to be described.

In the present preferred embodiment, a return pipe that returns an excess amount of the fuel to a sub fuel tank 3 is not connected to the fuel injection device 31*f*. Therefore, all the fuel supplied to the fuel injection device 31*f* is injected into the intake pipe 31*c* (which is an example of all of the fuel being supplied to outside of the fuel pipe 5).

Next, the construction of the fuel supply system 1 will be explained. As shown in FIG. 2, the fuel supply system 1 includes the fuel supply pipe 2, the sub fuel tank 3, a booster pump 4, the fuel pipe 5, a fuel pressure sensor 6 and the controller 7.

The fuel supply pipe 2 is connected to the sub fuel tank 3. The fuel supply pipe 2 supplies the fuel to the sub fuel tank 3 from the main fuel tank 22 (see FIG. 1).

The sub fuel tank 3 stores the fuel to be supplied from the main fuel tank 22 through the fuel supply pipe 2. The sub fuel tank 3 includes a fuel storage 3S in which the fuel is stored. In the present preferred embodiment, the fuel storage 3S is a sealed region with liquid-tight and air-tight properties.

In the present preferred embodiment, a return pipe that returns an excess amount of the fuel inside the fuel pipe 5 to the sub fuel tank 3 is not connected to the sub fuel tank 3. Therefore, the sub fuel tank 3 stores only the fuel flowing therein through the fuel supply pipe 2.

The booster pump 4 is disposed inside the sub fuel tank 3. The booster pump 4 increases the pressure of the fuel stored in the sub fuel tank 3 and discharges the fuel with an increased pressure to the fuel pipe 5. The booster pump 4 is preferably a so-called high pressure pump. A self-priming pump is usable as the booster pump 4. A positive displacement pump is an exemplary self-priming pump. The positive displacement pump encompasses a reciprocating positive displacement pump (plunger pump, piston pump, etc.), a rotary positive displacement pump (gear pump, etc.) and so forth. The booster pump 4 is able to perform an intermittent operation. In the intermittent operation, driving and stopping of the booster pump 4 are alternately repeated. The operation of the booster pump 4 is controlled by the controller 7.

In the present preferred embodiment, the fuel storage 3S of the sub fuel tank 3 has liquid tight and air tight properties. Hence, discharging of the fuel by the booster pump 4 causes suction of the fuel from the main fuel tank 22 to the sub fuel tank 3.

The fuel pipe 5 is connected to the sub fuel tank 3 and the fuel injection device 31*f* of the engine 31. The fuel pipe 5 supplies the fuel with a pressure increased by the booster pump 4 to the fuel injection device 31*f*. The fuel pipe 5 includes a first fuel hose 5*a*, a branch fitting 5*b* and a second fuel hose 5*c*. The first fuel hose 5*a* is connected to the booster pump 4 and the branch fitting 5*b*. The branch fitting 5*b* includes a tee (three-way) structure. The second fuel hose 5*c* is connected to the branch fitting 5*b* and the fuel injection device 31*f*. The fuel increased in pressure by the booster pump 4 is supplied to the fuel injection device 31*f* through the first fuel hose 5*a*, the branch fitting 5*b* and the second fuel hose 5*c*.

In the present preferred embodiment, the fuel pipe 5 preferably has a returnless structure. The term "returnless" means that a return pipe is not provided to return an excess amount of the fuel residing in the fuel pipe 5 to the sub fuel tank 3. Therefore, all of the fuel discharged from the sub fuel tank 3 to the fuel pipe 5 by the booster pump 4 is injected into the intake pipe 31*c* (which is an example of all of the fuel being supplied to outside of the fuel pipe 5) by the fuel injection device 31*f*.

The fuel pressure sensor 6 is connected to the branch fitting 5*b*. The fuel pressure sensor 6 detects the pressure of the fuel inside the fuel pipe 5. The fuel pressure sensor 6 outputs the detected value of the fuel pressure to the controller 7.

The controller 7 is configured or programmed to control the fuel injection device 31*f* and the booster pump 4 based on the value of the fuel pressure detected by the fuel pressure sensor 6. Control of the fuel injection device 31*f* by the controller 7 and that of the booster pump 4 by the controller 7 will be hereinafter explained respectively.

Figure 3:
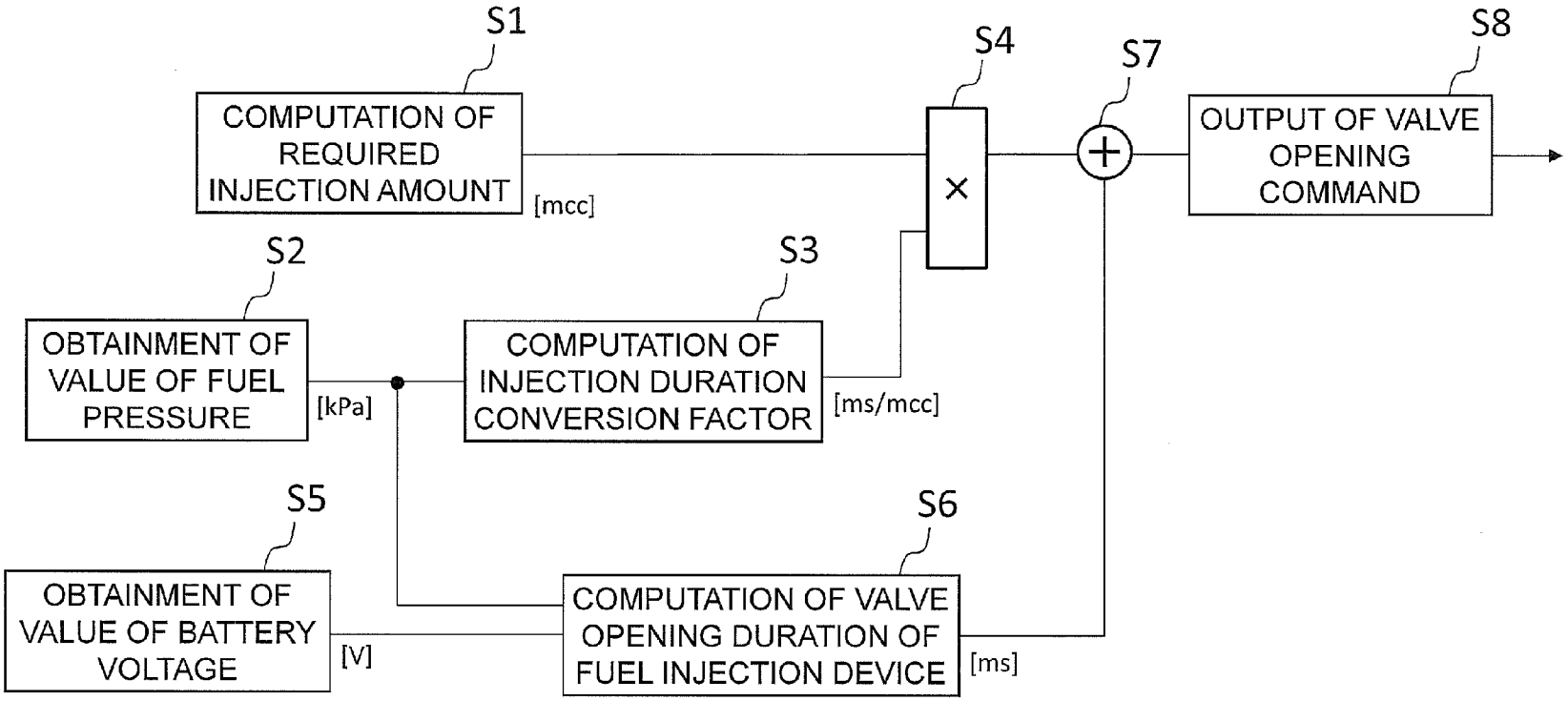
FIG. 3 is a circuit diagram for explaining a computing flow of an injection duration.

The controller 7 is configured or programmed to control the duration of injection by the fuel injection device 31*f* based on the amount of the fuel required to be injected by the fuel injection device 31*f* (hereinafter referred to as "required injection amount"), the value of the fuel pressure detected by the fuel pressure sensor 6, and the value of a voltage of a battery, not shown in the drawings. FIG. 3 is a circuit diagram for explaining a computing flow of an injection duration to be performed by the controller 7.

In step S1, the controller 7 is configured or programmed to compute the required injection amount based on the rotation speed of the engine 31 and a load of the engine 31 (an intake load or an opening degree of the throttle valve 31*e*). In step S2, the controller 7 is configured or programmed to obtain the value of the fuel pressure detected by the fuel pressure sensor 6. In step S3, the controller 7 is configured or programmed to compute an injection duration conversion factor, indicating a period of time required for the fuel injection device 31*f* to inject a unit volume of the fuel, based on the value of the fuel pressure. In step S4, the controller 7 is configured or programmed to compute a period of time required to inject the required injection amount of the fuel by multiplying the required injection amount and the injection duration conversion factor.

In step S5, the controller 7 is configured or programmed to obtain the value of the battery voltage. In step S6, the controller 7 is configured or programmed to compute a valve opening duration, indicating a period of time required for an injection valve to be opened from its closed state in the fuel injection device 31*f*, based on the value of the fuel pressure and the value of the battery voltage. The valve opening duration gets longer with an increase in the value of the fuel pressure, and also gets longer with a reduction in the value of the battery voltage. In step S7, the controller 7 is configured or programmed to compute the valve opening command duration, indicating a period of time that a valve opening command is issued to the fuel injection device 31*f*, by adding the injection duration and the valve opening duration.

In step 8, the controller 7 is configured or programmed to output the valve opening command (electric current) to the fuel injection device 31*f* at an injection timing depending on the rotation speed of the engine 31 during the computed valve opening command duration. As a result, the fuel injection device 31*f* injects the required injection amount of the fuel to the intake pipe 31*c* during the injection duration.

Figure 4:
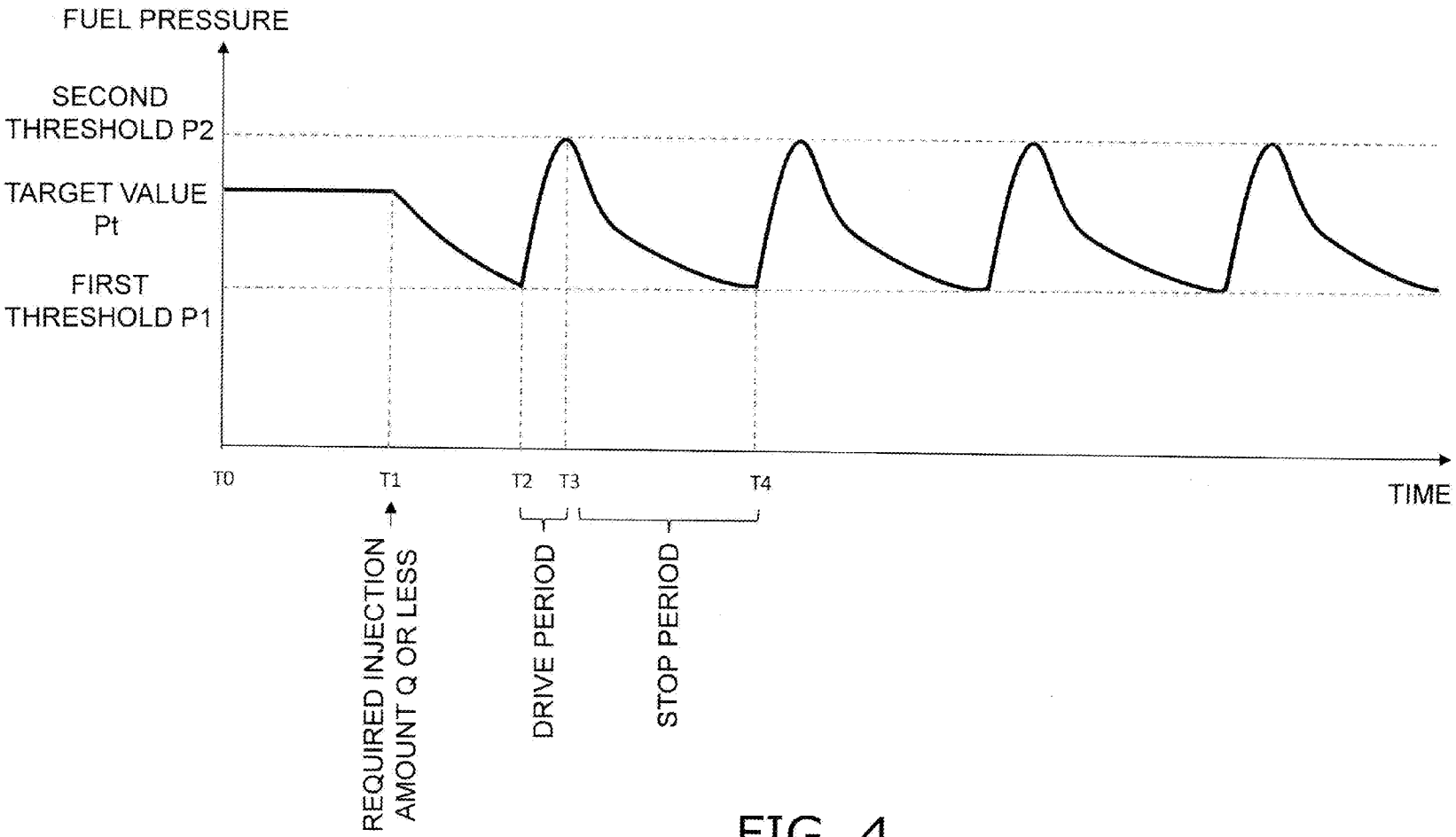
FIG. 4 is a chart showing a time-series variation in the value of the fuel pressure.

The controller 7 is configured or programmed to control electric power to be supplied to the booster pump 4 based on the value of the fuel pressure detected by the fuel pressure sensor 6. FIG. 4 is a chart showing a time-series variation in the value of the fuel pressure detected by the fuel pressure sensor 6.

The controller 7 is configured or programmed to compute the required injection amount, indicating the amount of the fuel required to be injected by the fuel injection device 31*f*, based on the rotation speed and the load of the engine 31 (see step S1 in FIG. 3). When the required injection amount is greater than or equal to a predetermined threshold Q, the controller 7 is configured or programmed to perform a feedback control of the booster pump 4 such that the fuel pressure inside the fuel pipe 5 reaches a predetermined target value Pt. When the value of the fuel pressure detected by the fuel pressure sensor 6 is greater than the target value Pt, the controller 7 is configured or programmed to reduce the electric power supplied to the booster pump 4. By contrast, when the value of the fuel pressure detected by the fuel pressure sensor 6 is less than the target value Pt, the controller 7 is configured or programmed to increase electric power supplied to the booster pump 4. In FIG. 4, the required injection amount is greater than or equal to the threshold Q in a period from time T0 to time T1.

When the required injection amount becomes less than or equal to the threshold Q, the controller 7 is configured or programmed to start performing an intermittent operation of the booster pump 4. The controller 7 is configured or programmed to stop electric power supply to the booster pump 4 at a point in time that the required injection amount becomes less than or equal to the threshold Q. It is preferable that an FET (field effect transistor) is embedded in the controller 7 as a switching element to switch enabling and disabling the electric power supplied to the booster pump 4. Accordingly, the electric power supply to the booster pump 4 is almost completely stopped. In FIG. 4, the required injection amount is the threshold Q at time T1.

When the value of the fuel pressure detected by the fuel pressure sensor 6 decreases to a first threshold P1 (lower limit) after electric power supply to the booster pump 4 is stopped, the controller 7 is configured or programmed to restart electric power supply to the booster pump 4. The first threshold P1 is a value smaller than the target value Pt. In FIG. 4, the value of the fuel pressure is the first threshold P1 at time T2.

When the value of the fuel pressure detected by the fuel pressure sensor 6 increases to a second threshold P2 (upper limit) after electric power supply to the booster pump 4 is restarted, the controller 7 is configured or programmed to again stop electric power supply to the booster pump 4. In FIG. 4, the value of the fuel pressure is the second threshold P2 at time T3. A period from time T2 to time T3 is a drive period in which the booster pump 4 is driven.

When the value of the fuel pressure detected by the fuel pressure sensor 6 decreases to the first threshold P1 after electric power supply to the booster pump 4 is again stopped, the controller 7 is configured or programmed to restart electric power supply to the booster pump 4. In FIG. 4, the value of the fuel pressure is the first threshold P1 at time T4. A period from time T3 to time T4 is a stop period in which the booster pump 4 is stopped. Subsequently, the controller 7 is configured or programmed to continue the intermittent operation to alternately repeat the drive period and the stop period of the booster pump 4. When the required injection amount becomes greater than the threshold Q, the controller 7 is configured or programmed to finish performing the intermittent operation of the booster pump 4.

Figure 5:
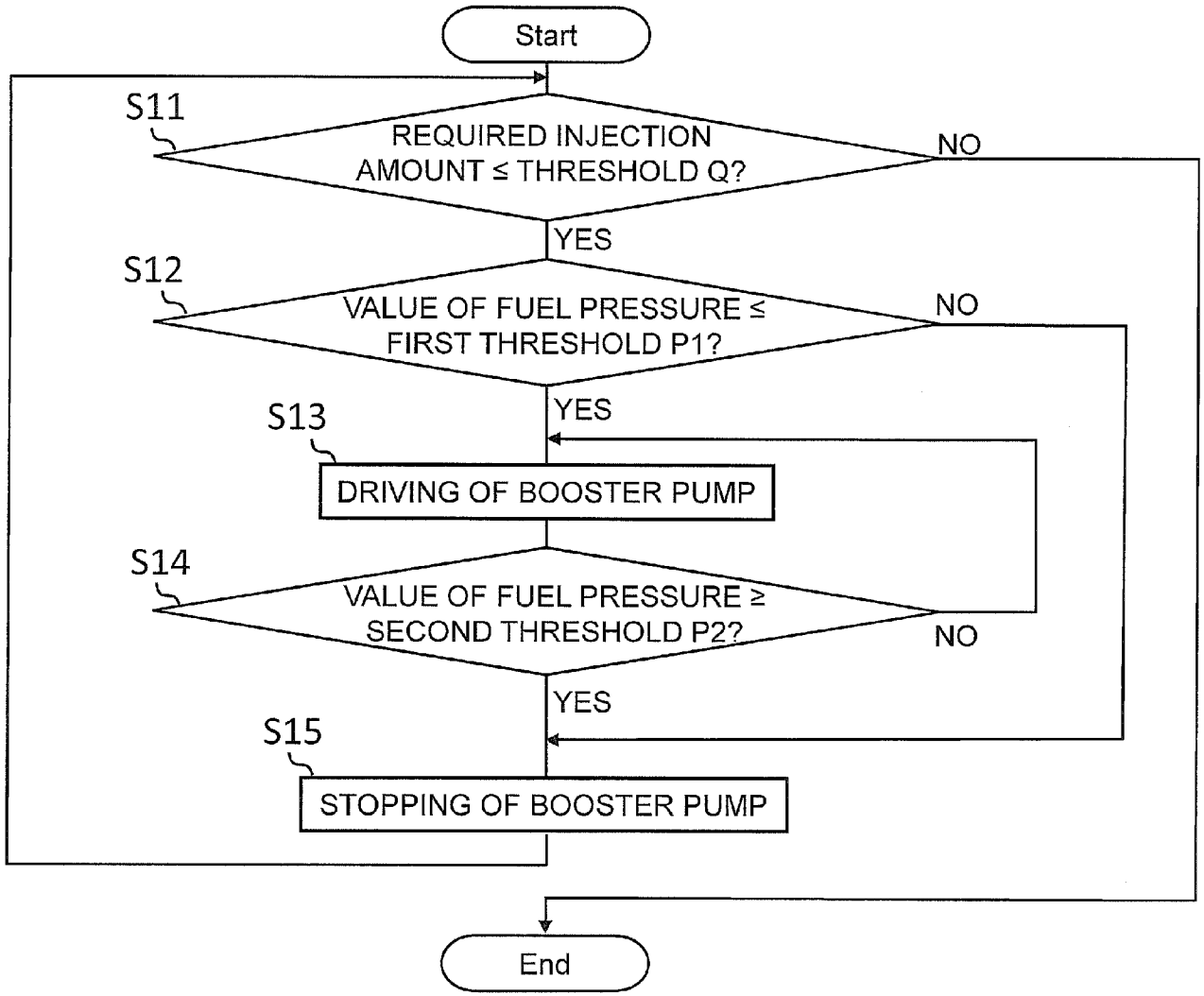
FIG. 5 is a flowchart for explaining an intermittent operational control.

FIG. 5 is a flowchart for explaining an intermittent operational control to be performed by the controller 7 with respect to the booster pump 4.

In step S11, the controller 7 determines whether or not the required injection amount in the engine 31 is less than or equal to the threshold Q. When the required injection amount is greater than the threshold Q, the controller 7 finishes the process without starting to perform the intermittent operation. When the required injection amount is less than or equal to the threshold Q, the controller 7 is configured or programmed to start performing the intermittent operation as follows. In step S12, the controller 7 determines whether or not the value of the fuel pressure detected by the fuel pressure sensor 6 is less than or equal to the first threshold P1. When the value of the fuel pressure is not less than or equal to the first threshold P1, the controller 7 proceeds with the process to step S15 and stops electric power supply to the booster pump 4. When the value of the fuel pressure is less than or equal to the first threshold P1, the controller 7 starts electric power supply to the booster pump 4 in step S13.

In step S14, the controller 7 determines whether or not the value of the fuel pressure detected by the fuel pressure sensor 6 is greater than or equal to the second threshold P2. When the value of the fuel pressure is not greater than or equal to the second threshold P2, the controller 7 returns the process to step S13 and continues electric power supply to the booster pump 4. When the value of the fuel pressure is greater than or equal to the second threshold P2, the controller 7 stops electric power supply to the booster pump 4 in step S15. Subsequently, the controller 7 returns the process to step S11.

The controller 7 is configured or programmed to perform the feedback control of the booster pump 4 based on the value of the fuel pressure detected by the fuel pressure sensor 6 such that the fuel pressure inside the fuel pipe 5 becomes greater than or equal to the first threshold P1. With this configuration, an excess amount of the fuel does not reside in the fuel pipe 5. Therefore, the fuel pipe 5 is able to have a returnless structure. In other words, the excess amount of the fuel does not return to the sub fuel tank 3 through a return pipe. Hence, an increase in the temperature of the fuel inside the sub fuel tank 3 is prevented. As a result, the sub fuel tank 3 is not required to be equipped with a mechanism to cool the fuel (i.e., a fuel cooler). Additionally, the amount of energy to drive the booster pump 4 is not consumed when returning the excess amount of the fuel. Hence, energy loss of the booster pump 4 is significantly reduced or prevented.

The controller 7 is configured or programmed to perform the intermittent operation of the booster pump 4 when the required injection amount in the engine 31 is less than the predetermined threshold Q. In other words, the stop period in which the booster pump 4 does not generate heat is set, and additionally, heat to be generated in the drive period of the booster pump 4 is released to the outside together with the fuel to be discharged from the booster pump 4. Hence, an increase in the temperature of the fuel in the sub fuel tank 3 is further prevented. It should be noted that during the intermittent operation of the booster pump 4, the controller 7 is configured or programmed to control the injection duration of the fuel injection device 31*f* in accordance with the value of the fuel pressure such that the required injection amount is continuously injected by the fuel injection device 31*f*. Hence, a reduction in the rotation speed of the engine 31 is also prevented.

Preferred embodiments of the present invention have been explained above. However, the present invention is not limited to the aforementioned preferred embodiments, and a variety of changes can be made without departing from the scope of the present invention.

The engine 31 preferably includes a single fuel injection device 31*f*, but alternatively, the engine 31 may include a plurality of the fuel injection devices 31*f*.

The fuel injection device 31*f* preferably injects the fuel into the intake pipe 31*c*, but alternatively, may directly inject the fuel into the cylinder of the engine 31 (which is an example of all of the fuel being supplied to outside of the fuel pipe 5).

The sub fuel tank 3 preferably has liquid tight and air tight properties, but alternatively, it may not have liquid tight and air tight properties. In this case, it is preferred to provide a low pressure pump between the main fuel tank 22 and the sub fuel tank 3.

The controller 7 preferably is configured or programmed to control the injection duration in the fuel injection device 31*f* with reference to the required injection amount, the value of the fuel pressure and the value of the battery voltage. However, the controller 7 may perform this with reference to at least the required injection amount and the value of the fuel pressure.

The controller 7 preferably is configured or programmed to compute the injection duration in the fuel injection device 31*f* based on the injection duration computing flow shown in FIG. 3 with reference to the required injection amount, the value of the fuel pressure and the value of the battery voltage. However, the controller 7 may be configured or programmed to obtain the injection duration with use of a map in which the injection duration is associated with the required injection amount, the value of the fuel pressure and the value of the battery voltage.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A fuel supply system comprising;

a sub fuel tank that stores a fuel supplied thereto from a main fuel tank;

a booster pump disposed inside the sub fuel tank;

a fuel pipe with a returnless structure, the fuel pipe supplying the fuel with a pressure increased by the booster pump to a fuel injection device of an engine;

a fuel pressure sensor that detects a pressure of the fuel inside the fuel pipe; and a controller configured or programmed to perform a feedback control of the booster pump based on a value of the pressure of the fuel detected by the fuel pressure sensor such that the pressure of the fuel inside the fuel pipe becomes greater than or equal to a first threshold.

2. The fuel supply system according to claim 1, wherein the sub fuel tank is not provided with a return pipe connected thereto.

3. The fuel supply system according to claim 1, wherein the fuel injection device is not provided with a return pipe connected thereto.

4. The fuel supply system according to claim 1, wherein all of the fuel to be discharged from the sub fuel tank to the fuel pipe is discharged outside of the fuel pipe from the fuel injection device.

5. The fuel supply system according to claim 1, wherein the controller is configured or programmed to perform an intermittent operation of the booster pump such that the pressure of the fuel inside the fuel pipe becomes greater than or equal to the first threshold and becomes less than or equal to a second threshold, the second threshold being greater than the first threshold.

6. The fuel supply system according to claim 5, wherein the controller is configured or programmed to alternately repeat a drive period and a stop period in the intermittent operation, the drive period being set to drive the booster pump by supplying electric power to the booster pump, the stop period being set to stop the booster pump by stopping supplying electric power to the booster pump.

7. The fuel supply system according to claim 6, wherein the controller is configured or programmed to set the drive period such that the booster pump discharges an amount of the fuel required to be injected by the fuel injection device during the drive period.

8. The fuel supply system according to claim 5, wherein the controller is configured or programmed to control an injection duration of the fuel injection device based on at least the value of the pressure of the fuel inside the fuel pipe and an amount of the fuel required to be injected by the fuel injection device.

9. The fuel supply system according to claim 8, wherein the controller is configured or programmed to control the injection duration with reference to a map indicating a relationship at least between the value of the pressure of the fuel inside the fuel pipe and the amount of the fuel required to be injected.

10. The fuel supply system according to claim 5, wherein the controller is configured or programmed to perform the intermittent operation when an amount of the fuel required to be injected is less than a predetermined threshold.

11. A marine propulsion device configured to be attached to a watercraft hull including a main fuel tank, the marine propulsion device comprising:

an engine including a fuel injection device; and a fuel supply system that supplies fuel to the engine; wherein the fuel supply system includes:

a sub fuel tank that stores the fuel supplied thereto from the main fuel tank;

a booster pump disposed inside the sub fuel tank;

a fuel pipe with a returnless structure, the fuel pipe supplying the fuel with a pressure increased by the booster pump to the fuel injection device;

a fuel pressure sensor that detects the pressure of the fuel inside the fuel pipe; and a controller configured or programmed to perform a feedback control of the booster pump based on a value of the pressure of the fuel detected by the fuel pressure sensor such that the pressure of the fuel inside the fuel pipe becomes greater than or equal to a first threshold.

12. The marine propulsion device according to claim 11, wherein the booster pump supplies the fuel from the main fuel tank to the sub fuel tank.

13. An outboard motor configured to be attached to a watercraft hull including a main fuel tank, the outboard motor comprising:

an engine including a fuel injection device;

a cowl accommodating the engine; and a fuel supply system that supplies fuel to the engine; wherein the fuel supply system includes:

a sub fuel tank that stores the fuel supplied thereto from the main fuel tank;

a booster pump disposed inside the sub fuel tank;

a fuel pipe with a returnless structure, the fuel pipe supplying the fuel with a pressure increased by the booster pump to the fuel injection device;

a fuel pressure sensor that detects the pressure of the fuel inside the fuel pipe; and a controller configured or programmed to perform a feedback control of the booster pump based on a value of the pressure of the fuel detected by the fuel pressure sensor such that the pressure of the fuel inside the fuel pipe becomes greater than or equal to a first threshold; and the sub fuel tank is disposed inside the cowl.

* * * * *